US010310537B2

(12) United States Patent
Dong et al.

(10) Patent No.: US 10,310,537 B2
(45) **Date of Patent: *Jun. 4, 2019**

(54) VARIATION-TOLERANT VOLTAGE REFERENCE

(71) Applicant: THE REGENTS OF THE UNIVERSITY OF MICHIGAN, Ann Arbor, MI (US)

(72) Inventors: Qing Dong, Ann Arbor, MI (US); David T. Blaauw, Ann Arbor, MI (US); Dennis Sylvester, Ann Arbor, MI (US)

(73) Assignee: THE REGENTS OF THE UNIVERSITY OF MICHIGAN, Ann Arbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/622,202

(22) Filed: Jun. 14, 2017

(65) Prior Publication Data

US 2017/0357285 A1 Dec. 14, 2017

Related U.S. Application Data

(60) Provisional application No. 62/349,731, filed on Jun. 14, 2016.

(51) Int. Cl.
*G05F 3/20* (2006.01)
*G05F 3/26* (2006.01)
(Continued)

(52) U.S. Cl.
CPC ..... *G05F 3/262* (2013.01); *G05F 1/462* (2013.01); *G05F 1/463* (2013.01); *G05F 1/618* (2013.01)

(58) Field of Classification Search
CPC ..... G05F 1/462; G05F 1/463; G05F 1/618; G05F 3/262
See application file for complete search history.

(56) References Cited

U.S. PATENT DOCUMENTS 6,005,378 A * 12/1999 D'Angelo ..... G05F 3/242 323/273
6,160,393 A 12/2000 Ahn et al.
(Continued)

FOREIGN PATENT DOCUMENTS

EP 2706426 3/2014

OTHER PUBLICATIONS

Y. Wang, Z. Zhu, J. Yao and Y. Yang, "A 0.45-V, 14.6-nW CMOS Subthreshold Voltage Reference With No Resistors and No BJTs," in IEEE Transactions on Circuits and Systems II: Express Briefs, vol. 62, No. 7, pp. 621-625, Jul. 2015.*
(Continued)

*Primary Examiner* — Jue Zhang
*Assistant Examiner* — Jye-June Lee
(74) *Attorney, Agent, or Firm* — Harness, Dickey & Pierce, P.L.C.

(57) ABSTRACT

A sub-nW voltage reference is presented that provides inherently low process variation and enables trim-free operation for low-dropout regulators and other applications in nW microsystems. Sixty chips from three different wafers in 180 nm CMOS are measured, showing an untrimmed within-wafer σ/μ of 0.26% and wafer-to-wafer σ/μ of 1.9%. Measurement results also show a temperature coefficient of 48-124 ppm/° C. from −40° C. to 85° C. Outputting a 0.986V reference voltage, the reference operates down to 1.2V and consumes 114 pW at 25° C.

17 Claims, 6 Drawing Sheets

(51) Int. Cl.
*G05F 1/46* (2006.01)
*G05F 1/618* (2006.01)

(56) References Cited

U.S. PATENT DOCUMENTS 6,177,811 B1 * 1/2001 Fuse ..... H01L 27/1203 257/E27.112
6,713,996 B2 3/2004 Di Iorio
7,486,129 B2 2/2009 Pietri et al.
7,564,225 B2 7/2009 Moraveji et al.
7,843,253 B2 * 11/2010 Aota ..... G11C 5/147 323/313
7,994,848 B2 8/2011 Kothandaraman et al.
8,531,169 B2 9/2013 Marinca
8,564,275 B2 10/2013 Seok et al.
8,786,355 B2 7/2014 Hao et al.
9,418,333 B2 8/2016 Kim et al.
2015/0045643 A1 2/2015 Varel et al.

OTHER PUBLICATIONS

"A yield improvement technique in severe process, voltage, and temperature variations and extreme voltage scaling," M. Radfar, J. Singh, Microelectronics Reliability, vol. 54 Issue 12, pp. 2813-2823, 2014.*
L. Magnelli et al "A 2.6nW, 0.45 V Temperature-Compensated Subthreshold CMOS Voltage Reference" JSSC, (2011).
Y. Zeng et al "A 1.2NW, 2 IPPM/° C. Subthreshold CMOS Voltage Reference Without Resistors", IET Conference Proceedings Stevenage: The Institution of Engineering & Technology, (2013).
Y. Wang, Z. Zhu, J. Yao and Y. Yang, "A 0.45-V, 14.6-nW CMOS Subthreshold Voltage Reference With No Resistors and No BJTs," in IEEE Transactions on Circuits and Systems II: Express Briefs, vol. 62, No. 7, pp. 621-625.

* cited by examiner

VARIATION-TOLERANT VOLTAGE REFERENCE

CROSS-REFERENCE TO RELATED APPLICATIONS

This application claims the benefit of U.S. Provisional Application No. 62/349,731 filed on Jun. 14, 2016. The entire disclosure of the above application is incorporated herein by reference.

FIELD

The present disclosure relates to a variation-tolerant voltage reference circuit.

BACKGROUND

Voltage references in low-dropout regulators (LDOs), amplifiers, and analog-to-digital converters (ADCs) for nW systems, such as sensors and IoT devices, can tolerate ~5% inaccuracy, but they require sub-nW power consumption. Conventional bandgap voltage references achieve excellent uniformity across process variation and temperature, but their complexity leads to μW range power, which is unacceptable for emerging nW microsystems. To achieve low power, one approach is to use a $V_{th}$-based voltage reference with devices biased in the sub-threshold region. However, these sub-nW voltage references make use of native transistors, which are potentially at different corners than normal devices due to distinct doping processes, making them more sensitive to process variations. Also, native transistors are not provided by all fabrication technologies and the output reference voltage is too low if an NMOS diode is used. Combining the native NMOS with stacked PMOS diodes can increase the reference voltage, but this further enlarges variation across corners.

For both bandgap references and the aforementioned sub-threshold references, post-fabrication trimming of each chip is required to alleviate the impact of process variations. However, this is a significant expense in cost-sensitive designs because of area overhead and testing complexity. In addition, non-volatile memory such as one-time-programmable (OTP) memory is required to store the trimming configuration information, requiring extra fabrication masks at increased cost. This paper proposes an ultra-low power PMOS-only voltage reference. By using only PMOS transistors, the reference has inherently low process variation. The untrimmed within-wafer σ/μ is 0.26%, and the untrimmed wafer-to-wafer σ/μ of 1.9%, which is sufficient for many applications in nW systems. With a 0.986V output reference voltage, the design can function down to 1.2V and consumes only 114 pW.

This section provides background information related to the present disclosure which is not necessarily prior art.

SUMMARY

This section provides a general summary of the disclosure, and is not a comprehensive disclosure of its full scope or all of its features.

A voltage reference circuit is presented. The voltage reference circuit is comprised of a first MOSFET and a second MOSFET having same type of charge carrier as the first MOSFET. The gate terminal of the first MOSFET is coupled to the source terminal of the first MOSFET and the body terminal of the first MOSFET is biased with a voltage that is different than the voltage at the source terminal and the voltage at the drain terminal. The second MOSFET is configured in a stacked arrangement with the first MOSFET such that a reference voltage is generated at a node interconnecting the first MOSFET to the second MOSFET. Of note, the threshold voltage of the first MOSFET and threshold voltage of the second MOSFET are designed to be the same and the gate terminal of the second MOSFET is coupled to the drain terminal of the second MOSFET.

In one embodiment, the first MOSFET and the second MOSFET are p-type such that the drain terminal of the first MOSFET is electrically coupled at the node to the source terminal of the second MOSFET.

In another embodiment, the first MOSFET and the second MOSFET are n-type such that the source terminal of the first MOSFET is electrically coupled at the node to the drain terminal of the second MOSFET.

The voltage reference circuit may include a bias circuit comprised of transistors only having same type of charge carrier as the first MOSFET and configured to output the voltage that biases the body terminal of the first MOSFET. In one embodiment, the bias circuit includes a third MOSFET in a stacked arrangement with a fourth MOSFET, such that a drain terminal of the third MOSFET is electrically coupled at an output node to a source terminal of the fourth MOSFET.

In another aspect of this disclosure, the bias circuit is configured to bias the body terminal of the first MOSFET with a bias voltage that changes with temperature changes so that the reference voltage is temperature independent.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
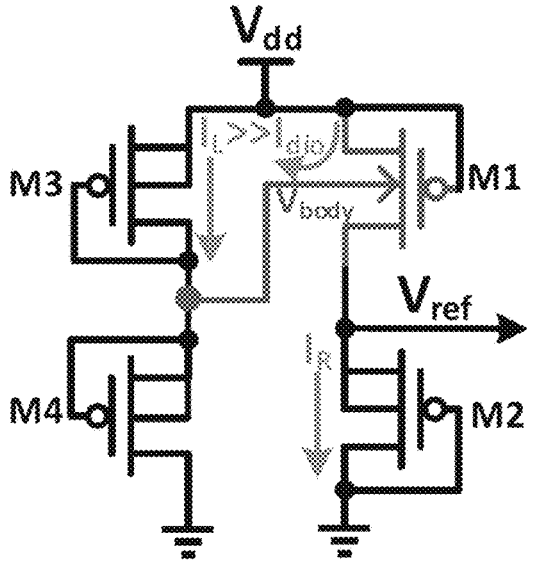
FIG. 1 shows a simplified circuit of proposed voltage reference circuit.

FIG. 1 shows a simplified structure of the proposed voltage reference circuit 10. The proposed voltage reference circuit is comprised of two metal-oxide semiconductor field-effect transistors (MOSFETs) M1, M2 in a stacked arrangement and a bias circuit 12. In the stacked arrangement, the two MOSFETs M1, M2 are configured with one of the source terminal and the drain terminal of the first MOSFET M1 coupled to a first supply voltage VDD, and the other of the source terminal and the drain terminal of the first MOSFET is coupled to one of the source terminal and the drain terminal of the second MOSFET M2. The other of the source terminal and the drain terminal of the second MOSFET M2 is coupled to a second supply voltage (e.g., ground). The first MOSFET M1 and the second MOSFET M2 have the same type of charge carrier and the particular terminal connections will depend upon the type of charge carrier as further described below.

Additionally, the gate terminal of the first MOSFET M1 is coupled to the source terminal of the first MOSFET M1 and the gate terminal of the second MOSFET M2 is coupled to the drain terminal of the second MOSFET M2. Of note, the body terminal of the first MOSFET M1 is biased with a voltage that is different than the voltage at either the source terminal or the drain terminal of the first MOSFET M1. It is also noted that the threshold voltage $V_{th1}$ of the first MOSFET M1 and threshold voltage $V_{th2}$ of the second MOSFET M2 are designed and manufactured to be the same.

In a first example embodiment, the first MOSFET M1 and second MOSFET M2 are p-type as seen in FIG. 1. In the stacked arrangement, source terminal of the first MOSFET M1 is electrically coupled to the upper supply voltage ($V_{dd}$) while the drain terminal of the first MOSFET M1 is electrically coupled to the source terminal of the second MOSFET M2 and the drain terminal of the second MOSFET M2 is electrically coupled to the lower supply voltage (e.g., ground). The reference voltage $V_{ref}$ is generated at an output node interconnecting the first MOSFET M1 to the second MOSFET M2.

In operation, the first MOSFET M1 is forward-biased and provides sub-threshold current flowing through the second MOSFET (i.e., bottom PMOS diode) M2. The second MOSFET M2 is in an off state. The current equations of M1 and M2 are expressed as in equation (1). By solving equation (1), $V_{ref}$ can be expressed as equation (3). As M1 and M2 are the same type of charge carrier (i.e, PMOS), the difference between $V_{th1}$ and $V_{th2}$ comes solely from the body bias effect of M1. Random $V_{th}$ mismatch is kept negligible by upsizing (e.g., >20 $\mu m^2$) of all 4 devices in this reference circuit.

$$I_R = u_p C_{ox} \frac{W_1}{L_1} n V_T^2 \exp\left(\frac{0 - V_{th1}}{m V_T}\right) = u_p C_{ox} \frac{W_2}{L_2} n V_T^2 \exp\left(\frac{0 - V_{ref} - V_{th2}}{m V_T}\right) \tag{1}$$

$$I_L = u_p C_{ox} \frac{W_3}{L_3} n V_T^2 \exp\left(\frac{V_{body} - V_{dd} - V_{th3}}{m V_T}\right) = u_p C_{ox} \frac{W_4}{L_4} n V_T^2 \exp\left(\frac{0 - V_{th4}}{m V_T}\right) \tag{2}$$

$$V_{ref} = V_{th1} - V_{th2} + m V_T \ln \frac{W_1 L_2}{W_2 L_1} \tag{3}$$

$$= \gamma\left(\sqrt{2\phi_b - m V_T \ln \frac{W_4 L_3}{W_3 L_4}} - \sqrt{2\phi_b}\right) + m V_T \ln \frac{W_1 L_2}{W_2 L_1} \tag{4}$$

The bias circuit 12 is configured to output the voltage that biases the body terminal of the first MOSFET M1. In the example embodiment, the bias circuit 12 is comprised of transistors having the same type of charge carrier as the first MOSFET M1 and the second MOSFET M2. That is, the third MOSFET M3 and the fourth MOSFET M4 are p-type as well. More specifically, the third MOSFET M3 and the fourth MOSFET M4 are in a stacked arrangement, such that the drain terminal of the third MOSFET M3 is electrically coupled at a bias node to the source terminal of the fourth MOSFET M4. The bias node is also electrically coupled to the body terminal of the first MOSFET to supply the bias voltage thereto.

Figure 2:
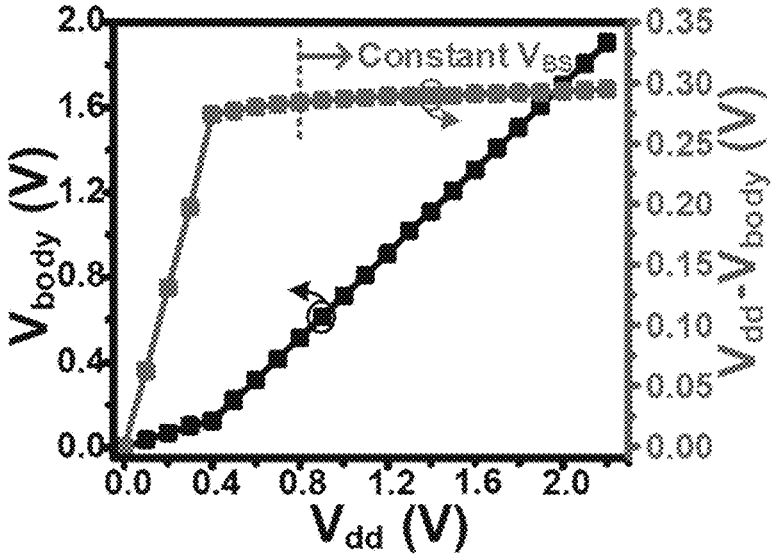
FIG. 2 is a graph showing how $V_{body}$ tracks $V_{dd}$ change and creates constant $V_{BS}$ for the first MOSFET.

In operation, the third MOSFET M3 and the fourth MOSFET M4 generate the required body bias for first MOSFET M1. More specifically, the fourth MOSFET M4 is an off-state PMOS; whereas, the third MOSFET is a PMOS diode. The current equations of M3 and M4 are expressed above in equation (2). As the third MOSFET and the fourth MOSFET M3 and M4 are also the same type of PMOS, $V_{th3}$ and $V_{th4}$ are essentially identical. The combination of the third MOSFET M3 and the fourth MOSFET M4 provides a body-bias voltage $V_{body}$ that tracks $V_{dd}$ and creates a constant $V_{BS}$ ($V_{body}$–$V_{dd}$) for first MOSFET M1 as shown in FIG. 2. If the current through third MOSFET M3 ($I_L$) is much larger than the parasitic diode current ($I_{dio}$) from the source to the N-well of M1, $V_{ref}$ can be expressed by equation (4). The left term of Equation (4) is complementary to temperature; whereas, the right term is proportional to temperature. With proper sizing of the four transistors, the first-order temperature dependency can be cancelled out. That is, the bias is circuit can be configured to bias the body terminal of the first MOSFET with a bias voltage that changes with temperature changes so that the reference voltage is temperature independent. Moreover, the threshold voltage $V_{th}$ does not play a role in equation (4) because each pair (M1/M2 and M3/M4) uses the same type of PMOS, thus significantly reducing process variation. Since $I_{dio}$ is not well modeled, $I_L$ is designed to be three orders of magnitude larger than $I_{dio}$ to minimize the effect of $I_{dio}$. Proper sizing of these transistors can be determined using a global optimization tool.

Figure 3:
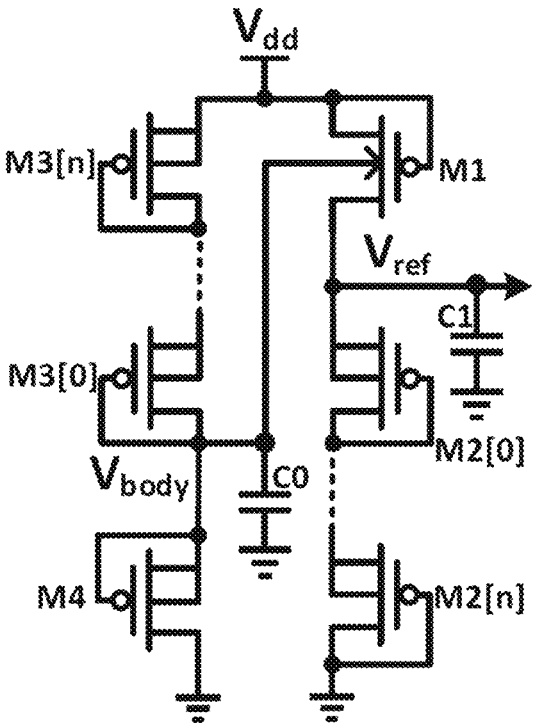
FIG. 3 is a schematic of the proposed voltage reference circuit with stacked PMOS diodes.

Variants of this proposed design are contemplated by this disclosure. Referring to FIG. 3, two or more stacked diodes can replace the second MOSFET M2 and the third MOSFET M3 to generate a higher reference voltage. Multiple voltage reference levels can be generated in this manner. In FIG. 3, three stages of PMOS diodes are used in the design to realize an approximately 1V output reference voltage. MIM capacitors C0 and C1 (both set to 1.78 pF) are used to isolate the reference voltage from high-frequency power supply noise. Except with respect to the differences discussed herein, the voltage reference circuit 30 may be substantially the same voltage reference circuit 10 described above.

Figure 4:
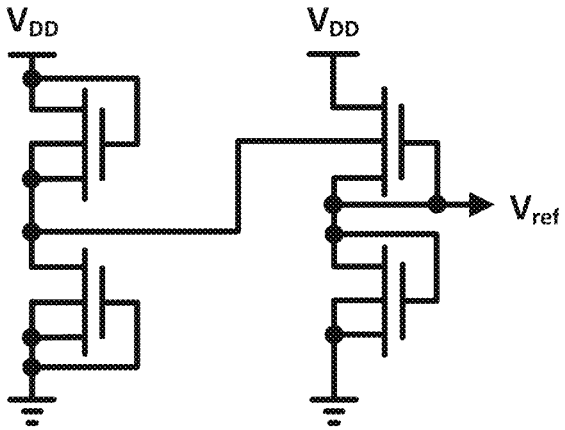
FIG. 4 is a schematic of a variant of the voltage reference circuit implemented with n-type transistors.

FIG. 4 depicts a variant of the voltage reference circuit 40 employing n-type transistors. In this variant, the drain terminal of the first MOSFET M1 is electrically coupled to the upper supply voltage while the source terminal of the first MOSFET M1 is electrically coupled to the drain terminal of the second MOSFET M2. The source terminal of the second MOSFET M2 is electrically coupled to the lower supply voltage, where magnitude of the upper supply voltage is larger than the lower supply voltage. Except with respect to the differences discussed herein, the voltage reference circuit 40 may be substantially the same voltage reference circuit 10 described above.

Figure 5:
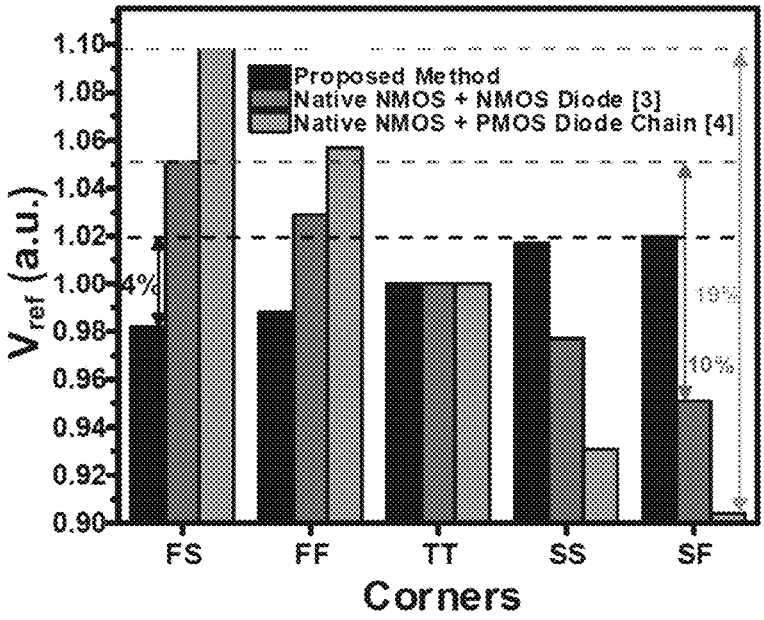
FIG. 5 is a graph showing a comparison of $V_{ref}$ simulation at all corners among the proposed design.

With continued reference to the voltage reference circuit 10 in FIG. 1, FIG. 5 compares simulated reference voltage distributions across corners for the proposed reference circuit 10 to designs presented by M. Seok et al. in JSSC, 2012 [3] and by I. Lee et al. in VLSI, 2014 [4]. The proposed design achieves <4% inaccuracy across all corners; whereas, the other designs vary up to 10% and 19%, respectively.

For verification, sixty chips from 3 different wafers in 180 nm CMOS were tested. One wafer was in a typical corner with thin top-metal, another was found to be at a slow corner with ultra-thick top-metal, and the third was at a fast corner with ultra-thick top-metal. All measurements are reported without trimming.

Figure 6:
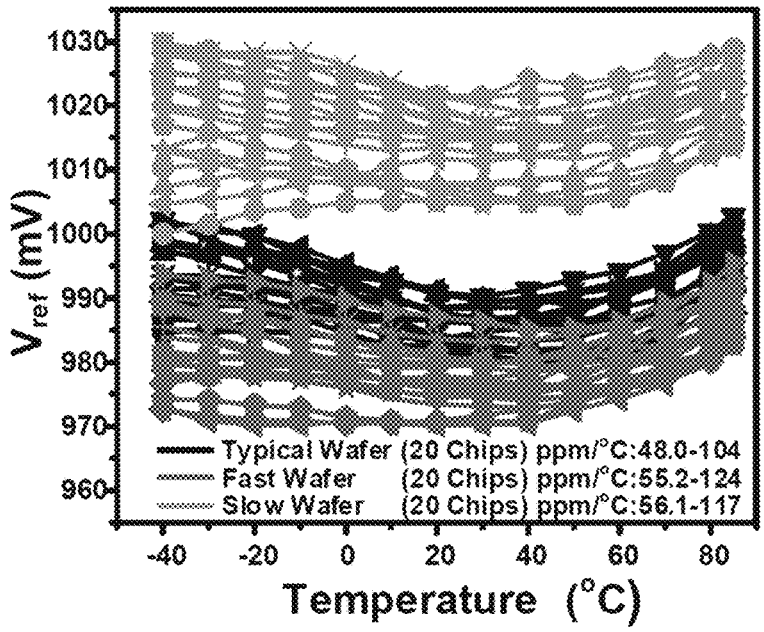
FIG. 6 is a graph showing the measured $V_{ref}$ across temperature for 3 wafers in 3 different corners.
Figure 7:
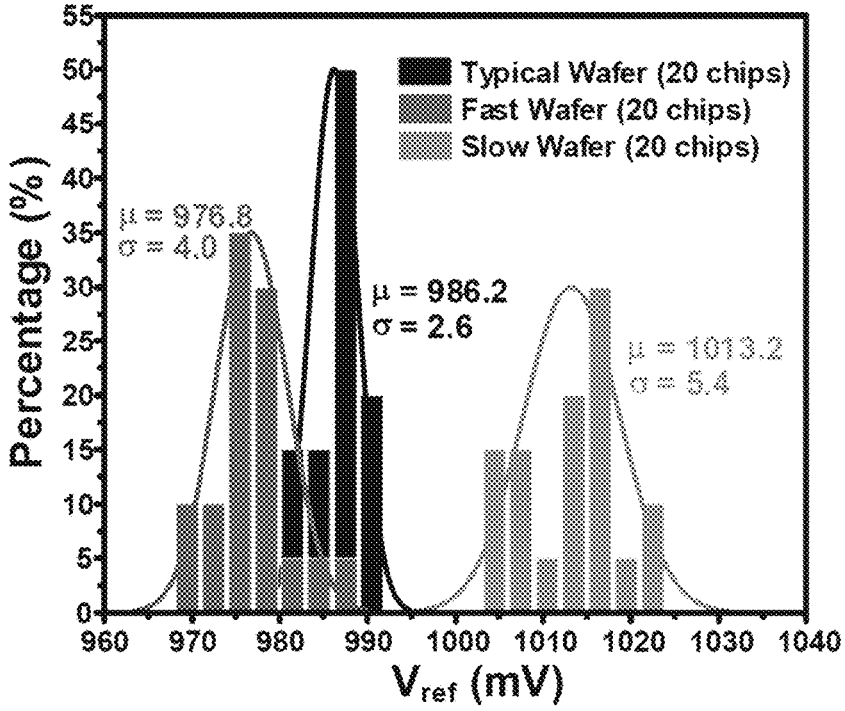
FIG. 7 is a graph showing the distribution of $V_{ref}$ on three different wafers.

FIG. 6 shows the measured reference voltage across temperature for all 60 chips. From −40° C. to 85° C., the temperature coefficient of the typical wafer ranges from 48 ppm/° C. to 104 ppm/° C., and those of the fast and slow wafers are 55.2-124 ppm/° C. and 56.1-117 ppm/° C., respectively. The reference voltage distributions at 25° C. of the 3 different wafers are shown in FIG. 7. Without trimming, the typical wafer shows a mean value of 986.2 mV and standard deviation of 2.6 mV. The average voltage difference between the fast and slow wafers is 3.6% (1.9% $\sigma/\mu$), matching simulation and providing sufficient accuracy for many key circuit applications within nW systems.

Figure 8:
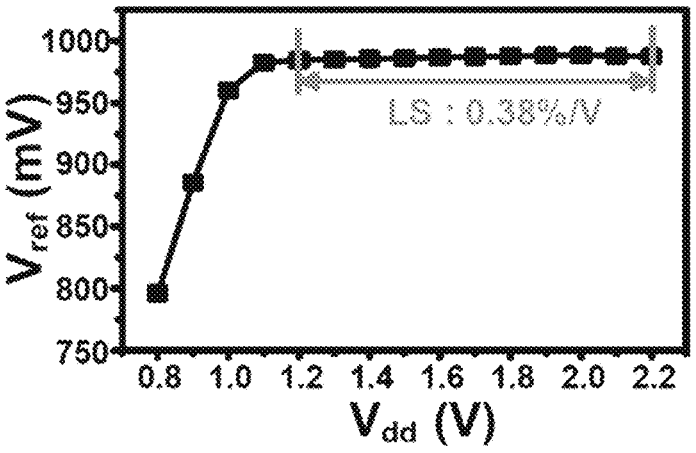
FIG. 8 is a graph showing the measured line sensitivity.
Figure 9:
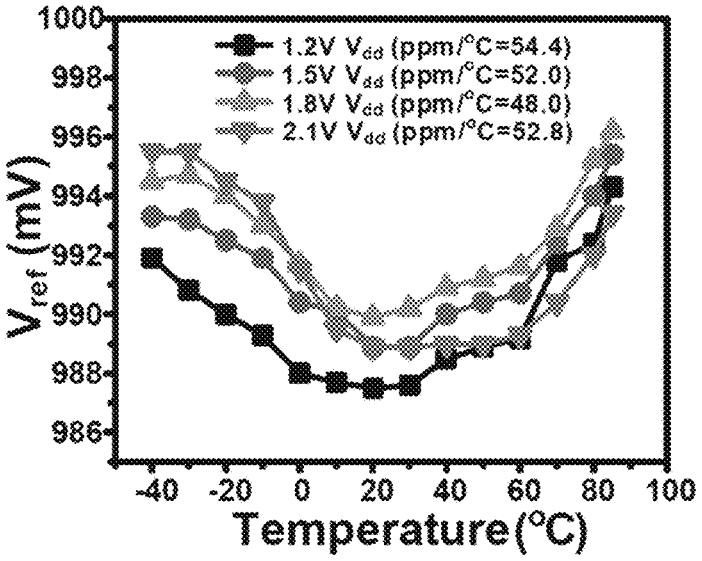
FIG. 9 is a graph showing the measured temperature coefficients at different $V_{dd}$.
Figure 10:
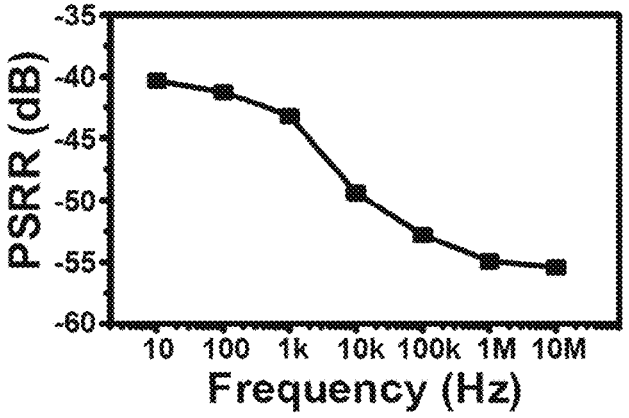
FIG. 10 is a graph showing the measured PSRR.

FIG. 8 shows the measured sensitivity of reference voltage to power supply voltage. Line sensitivity is 0.38% N from 1.2V to 2.2V. FIG. 9 shows the measured temperature coefficients at different supply voltages. FIG. 10 shows the measured power supply rejection ratio (PSRR) from 10 Hz to 10 MHz. High-frequency PSRR is −56 dB, which can be further improved with larger loading caps C0 and C1.

Figure 11A:
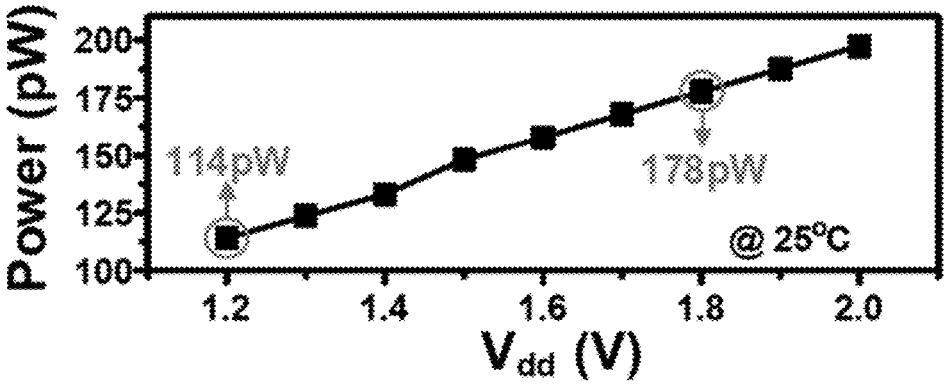
FIGS. 11A and 11B are graphs showing the measured power across $V_{dd}$ and temperature, respectively.
Figure 11B:
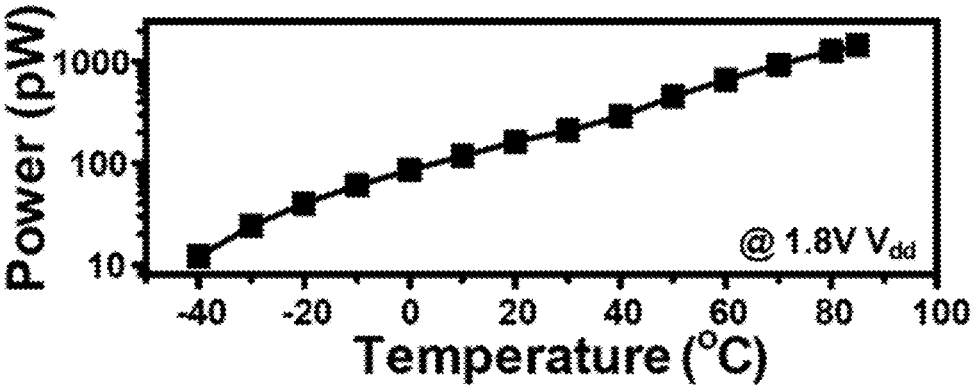

FIGS. 11A and 11B show the measured power consumption across supply voltage and temperature, respectively. The output reference voltage is approximately 1V with 3 stages of stacked PMOS diodes. The power supply can be reduced to 1.2V while maintaining this approximately 1V reference voltage. To lower the minimum power supply, fewer stages of PMOS diodes can be used, but the output reference voltage will be lowered as well. At 25° C. and 1.2V, the power consumption is 114 pW, which is suitable for low-power sensor and IoT applications.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A voltage reference circuit, comprising:

a first metal-oxide semiconductor field-effect transistor (MOSFET) having a source terminal, a drain terminal, a gate terminal and a body terminal, where the gate terminal of the first MOSFET is directly coupled to the source terminal of the first MOSFET and the body terminal of the first MOSFET is biased with a voltage that is different than a voltage at the source terminal and a voltage at the drain terminal; and a second MOSFET having same type of charge carrier as the first MOSFET and configured in a stacked arrangement with the first MOSFET such that a reference voltage is generated at a node interconnecting the first MOSFET to the second MOSFET, where threshold voltage of the first MOSFET and threshold voltage of the second MOSFET are designed to be the same and a gate terminal of the second MOSFET is directly coupled to a drain terminal of the second MOSFET.

2. The voltage reference circuit of claim 1 wherein the first MOSFET is forward biased and the second MOSFET is in an off state.

3. The voltage reference circuit of claim 1 wherein one of the source terminal and the drain terminal of the first MOSFET is coupled to a first supply voltage, and the other one of the source terminal and the drain terminal of the first MOSFET is coupled to one of the source terminal and the drain terminal of the second MOSFET, and the other one of the source terminal and the drain terminal of the second MOSFET is coupled to a second supply voltage, such that the first supply voltage is greater than the second supply voltage.

4. The voltage reference circuit of claim 1 wherein the first MOSFET and the second MOSFET are p-type such that the drain terminal of the first MOSFET is electrically coupled at the node to a source terminal of the second MOSFET.

5. The voltage reference circuit of claim 1 wherein the first MOSFET and the second MOSFET are n-type such that the source terminal of the first MOSFET is electrically coupled at the node to the drain terminal of the second MOSFET.

6. The voltage reference circuit of claim 1 further comprises a bias circuit comprised of transistors only having same type of charge carrier as the first MOSFET and configured to output the voltage that biases the body terminal of the first MOSFET.

7. The voltage reference circuit of claim 6 wherein the bias circuit includes a third MOSFET in a stacked arrangement with a fourth MOSFET, such that a drain terminal of the third MOSFET is electrically coupled at an output node to a source terminal of the fourth MOSFET.

8. The voltage reference circuit of claim 2 wherein the voltage that biases the body terminal of the first MOSFET is different than the first supply voltage and the second supply voltage.

9. A voltage reference circuit, comprising:

a first metal-oxide semiconductor field-effect transistor (MOSFET) having a source terminal, a drain terminal, a gate terminal and a body terminal, where the gate terminal of the first MOSFET is directly coupled to the source terminal of the first MOSFET;

a second MOSFET having same type of charge carrier as the first MOSFET and configured in a stacked arrangement with the first MOSFET such that a reference voltage is generated at a node interconnecting the first MOSFET to the second MOSFET, wherein threshold voltage of the first MOSFET and threshold voltage of the second MOSFET are designed to be the same and a gate terminal of the second MOSFET is directly coupled to a drain terminal of the second MOSFET; and a bias circuit configured to bias the body terminal of the first MOSFET with a bias voltage that changes with temperature changes so that the reference voltage is temperature independent.

10. The voltage reference circuit of claim 9 wherein the first MOSFET is forward biased and the second MOSFET is in an off state.

11. The voltage reference circuit of claim 9 wherein the bias voltage changes linearly with changes in temperature.

12. The voltage reference circuit of claim 9 wherein one of the source terminal and the drain terminal of the first MOSFET is coupled to a first supply voltage, and the other one of the source terminal and the drain terminal of the first MOSFET is coupled to one of the source terminal and the drain terminal of the second MOSFET, and the other one of the source terminal and the drain terminal of the second MOSFET is coupled to a second supply voltage, such that the first supply voltage is greater than the second supply voltage.

13. The voltage reference circuit of claim 9 wherein the first MOSFET and the second MOSFET are p-type such that the drain terminal of the first MOSFET is electrically coupled at the node to a source terminal of the second MOSFET.

14. The voltage reference circuit of claim 9 wherein the first MOSFET and the second MOSFET are n-type such that the source terminal of the first MOSFET is electrically coupled at the node to the drain terminal of the second MOSFET.

15. The voltage reference circuit of claim 9 wherein the bias circuit is comprised of transistors only having same type of charge carrier as the first MOSFET.

16. The voltage reference circuit of claim 9 wherein the bias circuit includes a third MOSFET in a stacked arrangement with a fourth MOSFET, such that a drain terminal of the third MOSFET is electrically coupled at an output node to a source terminal of the fourth MOSFET, and voltage at the output node is the bias voltage.

17. The voltage reference circuit of claim 12 wherein the voltage that biases the body terminal of the first MOSFET is different than the first supply voltage and the second supply voltage.

* * * * *